US010457878B2

(12) United States Patent
Eizenga et al.

(10) Patent No.: US 10,457,878 B2
(45) Date of Patent: Oct. 29, 2019

(54) PROCESS FOR RECOVERING HYDROCRACKED EFFLUENT

(71) Applicant: UOP LLC, Des Plaines, IL (US)

(72) Inventors: Donald A. Eizenga, Elk Grove Village, IL (US); Massimo Sangalli, Des Plaines, IL (US); Richard K. Hoehn, Mount Prospect, IL (US); Saadet Ulas Acikgoz, Des Plaines, IL (US); Trung Pham, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/710,626

(22) Filed: Sep. 20, 2017

(65) Prior Publication Data

US 2019/0085251 A1 Mar. 21, 2019

(51) Int. Cl.

| | |
|---|---|
| ***C10G 65/12*** | (2006.01) |
| ***C10G 49/22*** | (2006.01) |
| ***C10G 47/00*** | (2006.01) |
| ***C10G 7/00*** | (2006.01) |

(52) U.S. Cl.

CPC ..... *C10G 65/12* (2013.01); *C10G 7/00* (2013.01); *C10G 49/22* (2013.01); *C10G 47/00* (2013.01)

(58) Field of Classification Search

CPC ..... C10G 65/12; C10G 49/22; C10G 47/00
See application file for complete search history.

(56) References Cited

U.S. PATENT DOCUMENTS

| | | | | |
|---|---|---|---|---|
| 3,100,006 | A | 8/1963 | Sheets et al. | |
| 3,658,693 | A | 4/1972 | Hettick et al. | |
| 4,363,178 | A | 12/1982 | Erickson | |
| 4,673,490 | A | 6/1987 | Subramanian et al. | |
| 8,562,792 | B2 | 10/2013 | King et al. | |
| 8,852,425 | B2 | 10/2014 | Umansky et al. | |
| 8,911,694 | B2 | 12/2014 | Petri et al. | |
| 8,999,117 | B2 | 4/2015 | Schultz et al. | |
| 9,546,324 | B2 | 1/2017 | Kumar et al. | |
| 2014/0262946 | A1* | 9/2014 | Zhu | C10G 47/02 208/100 |

FOREIGN PATENT DOCUMENTS

| | | | |
|---|---|---|---|
| CN | 105802665 | A | 7/2016 |
| JP | 06026714 | B1 | 11/2016 |
| WO | 2017050795 | A1 | 3/2017 |

OTHER PUBLICATIONS

Schultz, "Reduce Costs with Dividing-Wall Columns", www.cepmagazine.org, May 2002, p. 64-71.
U.S. Appl. No. 15/710,669, filed Sep. 20, 2017.

* cited by examiner

*Primary Examiner* — Randy Boyer
*Assistant Examiner* — Juan C Valencia
(74) *Attorney, Agent, or Firm* — Paschall & Maas Law Office, LLC; James C. Paschall

(57) ABSTRACT

We have discovered a process for hydrocracking a distillate stream and separating it into several product cuts including LPG, light naphtha, heavy naphtha and distillate without a stripper column. Additionally, no more than two heaters relying on external utilities are required for reboiling fractionator bottoms.

17 Claims, 2 Drawing Sheets

PROCESS FOR RECOVERING HYDROCRACKED EFFLUENT

FIELD

The field is the recovery of hydrocracked hydrocarbon streams, particularly hydrocracked distillate streams.

BACKGROUND

Hydroprocessing can include processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, a hydrocracking unit may contain one or more beds of the same or different catalyst. Hydrocracking can be performed with one or two hydrocracking reactor stages.

A hydroprocessing recovery section typically includes a series of separators in a separation section to separate gases from the liquid materials and cool and depressurize liquid streams to prepare them for fractionation into products. Hydrogen gas is recovered for recycle to the hydroprocessing unit. A stripper column for stripping hydroprocessed effluent with a stripping medium such as steam is used to remove unwanted hydrogen sulfide and other light gases from hydroprocessed liquid streams before product fractionation.

Hydroprocessing recovery sections comprising fractionation columns rely on external utilities that originate from outside of the hydroprocessing unit to provide heater duty to vaporize the fractionation materials. Fractionation sections that rely more on heat generated in the hydroprocessing unit than external utilities are more energy efficient.

In some regions, diesel demand is lower than demand for lighter fuel products. Distillate or diesel hydrocracking is proposed for producing the lighter fuel products such as naphtha and liquefied petroleum gas (LPG).

There is a continuing need, therefore, for improving the efficiency of processes for recovering fuel products from hydrocracked distillate stocks.

BRIEF SUMMARY

We have discovered a process for hydrocracking a distillate stream and separating it into several product cuts without a stripper column. Additionally, no more than two heaters that rely on external utilities are required for reboiling fractionator bottoms.

DEFINITIONS

Figure 1:
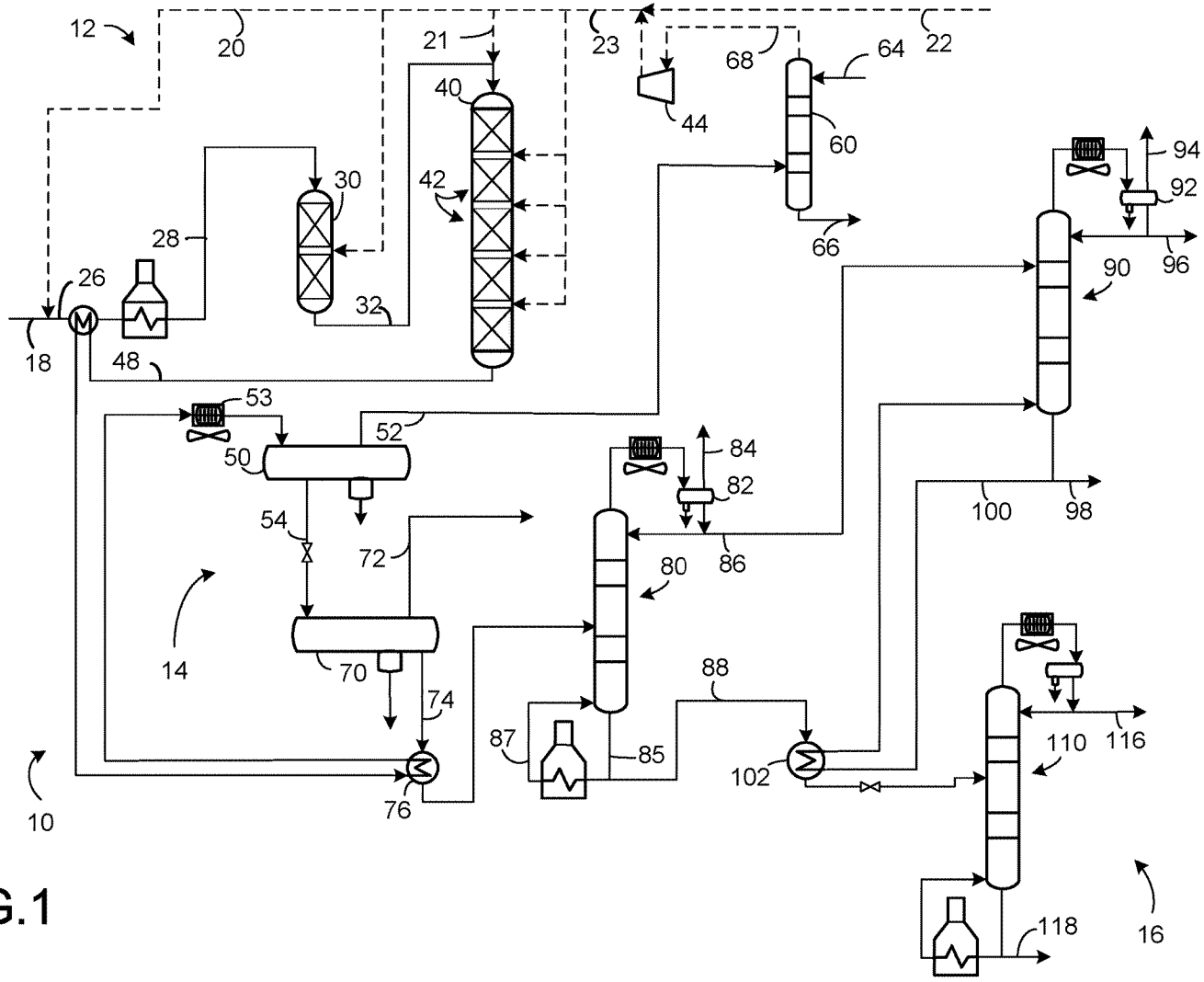
FIG. 1 is a simplified process flow diagram.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without passing through a fractionation or conversion unit to undergo a compositional change due to physical fractionation or chemical conversion.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripper columns may omit a reboiler at a bottom of the column and instead provide heating requirements and separation impetus from a fluidized inert media such as steam. Stripping columns typically feed a top tray and take stripped product from the bottom.

As used herein, the term "T5" or "T95" means the temperature at which 5 liquid volume percent or 95 liquid volume percent, as the case may be, respectively, of the sample boils using ASTM D-86 or TBP.

As used herein, the term "external utilities" means utilities that originate from outside of the hydroprocessing unit to typically provide heater duty to vaporize fractionation materials. External utilities may provide heater duty through fired heaters, steam heat exchangers and hot oil heaters.

As used herein, the term "initial boiling point" (IBP) means the temperature at which the sample begins to boil using ASTM D-86 or TBP.

As used herein, the term "end point" (EP) means the temperature at which the sample has all boiled off using ASTM D-86 or TBP.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "naphtha boiling range" means hydrocarbons boiling in the range of an IBP between about 0° C. (32° F.) and about 100° C. (212° F.) or a T5 between about 15° C. (59° F.) and about 100° C. (212° F.) and the "naphtha cut point" comprising a T95 between about 150° C. (302° F.) and about 200° C. (392° F.) using the TBP distillation method.

As used herein, the term "diesel boiling range" means hydrocarbons boiling in the range of an IBP between about 125° C. (257° F.) and about 175° C. (347° F.) or a T5 between about 150° C. (302° F.) and about 200° C. (392° F.)

and the "diesel cut point" comprising a T95 between about 343° C. (650° F.) and about 399° C. (750° F.) using the TBP distillation method.

As used herein, the term "conversion" means conversion of feed to material that boils below the naphtha cut point. The naphtha cut point of the naphtha boiling range is between about 150° C. (302° F.) and about 200° C. (392° F.) using the True Boiling Point distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

DETAILED DESCRIPTION

A typical distillate hydrocracking recovery section comprises four columns. A stripping column strips hydrogen sulfide off of a liquid hydrocracked stream with a steam stream. A product fractionation column separating the stripped liquid hydrocracked stream into an overhead stream comprising LPG and naphtha and bottoms stream comprising kerosene product. The product overhead stream is fractionated in a debutanizer fractionation column into a debutanizer overhead stream comprising LPG and a debutanized bottoms stream comprising naphtha. The debutanized bottoms stream is fractionated in a naphtha splitter fractionation column into a light naphtha overhead stream and a heavy naphtha bottom stream. All three fractionation columns require a heater that uses external utilities to the hydrocracking unit such as a fired heater or other suitable heater such as a hot oil heat exchanger or high pressure steam heat exchanger for reboiling a portion of the bottoms stream before it is returned to the column or another heat input device such as a fractionation feed heater. The proposed process eliminates the stripping column and may omit one of the reboil heaters that use external utilities.

In the FIGS., a hydroprocessing unit 10 for hydroprocessing hydrocarbons comprises a hydroprocessing reactor section 12, a separation section 14 and a fractionation section 16. The hydroprocessing unit 10 is designed for hydrocracking diesel range hydrocarbons into distillate such as kerosene, naphtha and LPG products. A diesel stream in hydrocarbon line 18 and a hydrogen stream in hydrogen line 20 are fed to the hydroprocessing reactor section 12. Hydroprocessed effluent is separated in the separation section 14 and fractionated into products in the fractionation section 16.

Hydroprocessing that occurs in the hydroprocessing reactor section 12 may be hydrocracking and optionally hydrotreating. Hydrocracking is the preferred process in the hydroprocessing reactor section 12. Consequently, the term "hydroprocessing" will include the term "hydrocracking" herein.

In one aspect, the process and apparatus described herein are particularly useful for hydrocracking a hydrocarbon feed stream comprising distillate. A suitable distillate may include a diesel feed boiling in the range of an IBP between about 125° C. (257° F.) and about 175° C. (347° F.) or a T5 between about 150° C. (302° F.) and about 200° C. (392° F.) and a "diesel cut point" comprising a T95 between about 343° C. (650° F.) and about 399° C. (750° F.) using the TBP distillation method.

The hydrogen stream in the hydrogen line 20 may split off from a hydroprocessing hydrogen line 23. The hydrogen stream in line 20 may be a hydrotreating hydrogen stream. The hydrotreating hydrogen stream may join the hydrocarbon stream in the hydrocarbon line 18 to provide a hydrocarbon feed stream in a hydrocarbon feed line 26. The hydrocarbon feed stream in the hydrocarbon feed line 26 may be heated by heat exchange with a hydrocracked stream in a hydrocracked effluent line 48 and in a fired heater. A heated hydrocarbon feed stream in hydroprocessing feed line 28 may be fed to an optional hydrotreating reactor 30.

Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Consequently, the term "hydroprocessing" may include the term "hydrotreating" herein.

The hydrotreating reactor 30 may be a fixed bed reactor that comprises one or more vessels, single or multiple beds of catalyst in each vessel, and various combinations of hydrotreating catalyst in one or more vessels. It is contemplated that the hydrotreating reactor 30 be operated in a continuous liquid phase in which the volume of the liquid hydrocarbon feed is greater than the volume of the hydrogen gas. The hydrotreating reactor 30 may also be operated in a conventional continuous gas phase, a moving bed or a fluidized bed hydrotreating reactor. The hydrotreating reactor 30 may provide conversion per pass of about 10 to about 30 vol %.

The hydrotreating reactor 30 may comprise a guard bed of specialized material for pressure drop mitigation followed by one or more beds of higher quality hydrotreating catalyst. The guard bed filters particulates and picks up contaminants in the hydrocarbon feed stream such as metals like nickel, vanadium, silicon and arsenic which deactivate the catalyst. The guard bed may comprise material similar to the hydrotreating catalyst. Supplemental hydrogen may be added at an interstage location between catalyst beds in the hydrotreating reactor 30.

Suitable hydrotreating catalysts are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present description that more than one type of hydrotreating catalyst be used in the same hydrotreating reactor 30. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.8 MPa (gauge) (400 psig) to about 17.5 MPa (gauge) (2500 psig), a liquid hourly space velocity of the fresh hydrocarbonaceous feedstock from about 0.1 $hr^{-1}$, suitably 0.5 $hr^{-1}$, to about 5 $hr^{-1}$, preferably from about 1.5 to about 4 $hr^{-1}$, and a hydrogen rate of about 84 $Nm^3/m^3$ (500 scf/bbl), to about 1,250 $Nm^3/m^3$ oil (7,500 scf/bbl), preferably about 168 $Nm^3/m^3$ oil (1,000 scf/bbl) to about 1,011 $Nm^3/m^3$ oil (6,000 scf/bbl), with a hydrotreating catalyst or a combination of hydrotreating catalysts.

The hydrocarbon feed stream in the hydrocarbon feed line 28 may be hydrotreated with the hydrotreating hydrogen stream from hydrotreating hydrogen line 20 over the hydrotreating catalyst in the hydrotreating reactor 30 to provide a hydrotreated hydrocarbon stream that exits the hydrotreating reactor 30 in a hydrotreated effluent line 32. The hydrotreated effluent stream still predominantly boils in the diesel boiling range and may be taken as a hydrocracking diesel feed stream. The hydrogen gas laden with ammonia and hydrogen sulfide may be removed from the hydrocracking diesel feed stream in a separator, but the hydrocracking diesel feed stream is suitably fed directly to the hydrocracking reactor 40 without separation. The hydrocracking diesel feed stream may be mixed with a hydrocracking hydrogen stream in a hydrocracking hydrogen line 21 taken from the hydroprocessing hydrogen line 23 and be fed through an inlet to the hydrocracking reactor 40 to be hydrocracked.

Hydrocracking is a process in which hydrocarbons crack in the presence of hydrogen to lower molecular weight hydrocarbons. The hydrocracking reactor 40 may be a fixed bed reactor that comprises one or more vessels, single or multiple catalyst beds 42 in each vessel, and various combinations of hydrotreating catalyst and/or hydrocracking catalyst in one or more vessels. It is contemplated that the hydrocracking reactor 40 be operated in a continuous liquid phase in which the volume of the liquid hydrocarbon feed is greater than the volume of the hydrogen gas. The hydrocracking reactor 40 may also be operated in a conventional continuous gas phase, a moving bed or a fluidized bed hydrocracking reactor.

The hydrocracking reactor 40 comprises a plurality of hydrocracking catalyst beds 42. If the hydrocracking reactor section 12 does not include a hydrotreating reactor 30, the catalyst beds 42 in the hydrocracking reactor 40 may include hydrotreating catalyst for the purpose of saturating, demetallizing, desulfurizing or denitrogenating the hydrocarbon feed stream before it is hydrocracked with the hydrocracking catalyst in subsequent vessels or catalyst beds 42 in the hydrocracking reactor 40.

The hydrotreated diesel feed stream is hydrocracked over a hydrocracking catalyst in the hydrocracking reactor 40 in the presence of the hydrocracking hydrogen stream from a hydrocracking hydrogen line 21 to provide a hydrocracked stream. A hydrogen manifold may deliver supplemental hydrogen streams to one, some or each of the catalyst beds 42. In an aspect, the supplemental hydrogen is added to each of the hydrocracking catalyst beds 42 at an interstage location between adjacent beds, so supplemental hydrogen is mixed with hydroprocessed effluent exiting from the upstream catalyst bed 42 before entering the downstream catalyst bed 42.

The hydrocracking reactor may provide a total conversion of at least about 20 vol % and typically greater than about 60 vol % of the hydrotreated hydrocarbon stream in the hydrocracking feed line 32 to products boiling below the cut point of the heaviest desired product which is typically naphtha. The hydrocracking reactor 40 may operate at partial conversion of more than about 30 vol % or full conversion of at least about 90 vol % of the feed based on total conversion. The hydrocracking reactor 40 may be operated at mild hydrocracking conditions which will provide about 20 to about 60 vol %, preferably about 20 to about 50 vol %, total conversion of the hydrocarbon feed stream to product boiling below the naphtha cut point.

The hydrocracking catalyst may utilize amorphous silica-alumina bases or zeolite bases upon which is deposited a Group VIII metal hydrogenating component. Additional hydrogenating components may be selected from Group VIB for incorporation with the base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,100,006.

Mixed polyvalent metal-hydrogen zeolites may be prepared by ion-exchanging with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 wt %, and preferably at least about 20 wt %, metal-cation-deficient, based on the initial ion-exchange capacity. In another aspect, a desirable and stable class of zeolites is one wherein at least about 20 wt % of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 wt % and about 30 wt % may be used. In the case of the noble metals, it is normally preferred to use about 0.05 to about 2 wt % noble metal.

The method for incorporating the hydrogenation metal is to contact the base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like if desired, and calcined in air at temperatures of, e.g., about 371° C. (700° F.) to about 648° C. (200° F.) in order to activate the catalyst and decompose ammonium ions. Alternatively, the base component may be pelleted, followed by the addition of the hydrogenation component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,178.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to about 2.5 $hr^{-1}$ and a hydrogen rate of about 421 $Nm^3/m^3$ (2,500 scf/bbl) to about 2,527 $Nm^3/m^3$ oil (15,000 scf/bbl). If mild hydrocracking is desired, conditions may include a temperature from about 35° C. (600° F.) to about 441° C. (825° F.), a pressure from about 5.5 MPa (gauge) (800 psig) to about 3.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

The hydrocracked stream may exit the hydrocracking reactor 40 in the hydrocracked effluent line 48 and be separated in the separation section 14 in downstream communication with the hydrocracking reactor 40 and optionally the hydrotreating reactor 30. The separation section 14 comprises one or more separators in downstream communication with the hydroprocessing reactor comprising the hydrotreating reactor 30 and/or the hydrocracking reactor 40. The hydrocracked stream in the hydrocracked effluent line 48 may in an aspect be heat exchanged with the hydrocarbon feed stream in the hydrocarbon feed line 26, further cooled in a cooler 53 and delivered to a cold separator 50. In a further aspect, the hydrocracked stream in the hydrocracked effluent line 48 may be subsequently heat exchanged with the cold flash liquid hydrocracked stream in a cold flash bottoms line 74 to further cool the hydrocracked stream and heat the cold flash liquid hydrocracked stream.

The cooled hydrocracked stream may be separated in the cold separator 56 to provide a cold vapor hydrocracked stream comprising a hydrogen-rich gas stream in a cold overhead line 52 extending from a top of the cold separator 50 and a cold liquid hydrocracked stream in a cold bottoms line 54 extending from a bottom of the cold separator 50. The cold separator 50 serves to separate hydrogen rich gas from hydrocarbon liquid in the hydroprocessed stream for recycle to the reactor section 12 in the cold overhead line 52. The cold separator 50, therefore, is in downstream communication with the hydrocracking reactor 40. The cold separator 50 may be operated at about 100° F. (38° C.) to about 150° F. (66° C.), suitably about 115° F. (46° C.) to about 145° F. (63° C.), and just below the pressure of the hydrocracking reactor 40 accounting for pressure drop through intervening equipment to keep hydrogen and light gases in the overhead and normally liquid hydrocarbons in the bottoms. The cold separator 50 may be operated at pressures between about 3 MPa (gauge) (435 psig) and about 20 MPa (gauge) (2,900 psig). The cold separator 50 may also have a boot for collecting an aqueous phase. The cold liquid hydrocracked stream in the cold bottoms line 54 may have a temperature of the operating temperature of the cold separator 50. In another aspect, an additional hot separator (not shown) may be used for enhanced heat recovery and heat exchange network optimization. The hot separator may be operated at about 250° F. (121° C.) to about 500° F. (260° C.) and at a pressure intermediate between the hydrocracking reactor and the cold separator.

The cold vapor hydrocracked stream in the cold overhead line 52 is rich in hydrogen. Thus, hydrogen can be recovered from the cold vapor hydrocracked stream. The cold vapor hydrocracked stream in the cold overhead line 58 may be passed through a trayed or packed recycle scrubbing column 60 where it is scrubbed by means of a scrubbing extraction liquid such as an aqueous solution fed by line 64 to remove acid gases including hydrogen sulfide by extracting them into the aqueous solution. Preferred aqueous solutions include lean amines such as alkanolamines DEA, MEA, and MDEA. Other amines can be used in place of or in addition to the preferred amines. The lean amine contacts the cold vapor hydrocracked stream and absorbs acid gas contaminants such as hydrogen sulfide. The resultant "sweetened" cold vapor hydrocracked stream is taken out from an overhead outlet of the recycle scrubber column 60 in a recycle scrubber overhead line 68, and a rich amine is taken out from the bottoms at a bottom outlet of the recycle scrubber column in a recycle scrubber bottoms line 66. The spent scrubbing liquid from the bottoms may be regenerated and recycled back to the recycle scrubbing column 60 in line 64. The scrubbed hydrogen-rich stream emerges from the scrubber via the recycle scrubber overhead line 68 and may be compressed in a recycle compressor 44. The scrubbed hydrogen-rich stream in the scrubber overhead line 68 may be supplemented with make-up hydrogen stream in the make-up line 22 upstream or downstream of the compressor 44. The compressed hydrogen stream supplies hydrogen to the hydrogen stream in the hydrogen line 23. The recycle scrubbing column 60 may be operated with a gas inlet temperature between about 38° C. (100° F.) and about 66° C. (150° F.) and an overhead pressure of about 3 MPa (gauge) (435 psig) to about 20 MPa (gauge) (2900 psig).

In an aspect, the cold liquid hydrocracked stream in the cold bottoms line 54 may be let down in pressure and flashed in a cold flash drum 70 to separate the cold liquid hydrocracked stream in the cold bottoms line 54. The cold flash drum 70 may be in direct, downstream communication with the cold bottoms line 54 of the cold separator 50 and in downstream communication with the hydrocracking reactor 40. The cold flash drum 70 may separate the cold liquid hydrocracked stream in the cold bottoms line 54 to provide a cold flash vapor hydrocracked stream in a cold flash overhead line 72 extending from a top of the cold flash drum 70 and a cold flash liquid hydrocracked stream in a cold flash bottoms line 74 extending from a bottom of the cold flash drum. In an aspect, light gases such as hydrogen sulfide are typically stripped from the cold flash liquid hydrocracked stream in the cold flash bottoms line 74. However, this discovered process omits a stripper column. The cold flash liquid hydrocracked stream is transported directly to a product fractionation column 80 after heat exchange with the hydrocracked stream in the hydrocracked effluent line 48 in a cold flash heat exchanger 76 to raise the temperature of the cold flash liquid hydrocracked stream to between 254° C. (490° F.) and about 282° C. (540° F.).

The cold flash drum 70 may be in downstream communication with the cold bottoms line 54 of the cold separator 50 and the hydrocracking reactor 40. The cold flash drum 70 may be operated at the same temperature as the cold separator 50 but typically at a lower pressure of between about 1.4 MPa (gauge) (200 psig) and about 6.9 MPa (gauge) (1000 psig) and preferably between about 2.4 MPa (gauge) (350 psig) and about 3.8 MPa (gauge) (550 psig). A flashed aqueous stream may be removed from a boot in the cold flash drum 70. The cold flash liquid hydrocracked stream exiting in the cold flash bottoms line 74 may have the same temperature as the operating temperature of the cold flash drum 70. The cold flash vapor hydrocracked stream in the cold flash overhead line 72 contains substantial hydrogen that may be scrubbed and recovered such as in a pressure swing adsorption unit. In another aspect, an additional hot flash drum (not shown) may be in downstream communication with the hot separator. The hot flash drum may be operated at the same temperature as the hot separator and at a pressure similar to the cold flash drum. Vapor from the hot flash drum may be cooled and combined with cold bottoms line 54 to the inlet of the cold flash drum.

The fractionation section 16 may include a product fractionation column 80, a debutanizer fractionation column 90 and a main fractionation column 110. The cold flash liquid hydrocracked stream in the cold flash bottoms line 74 may comprise predominantly LPG, naphtha and distillate materials comprising kerosene and/or diesel. The cold flashed liquid hydrocracked stream in the cold flash bottoms line 74 may be heated by heat exchange with the hydrocracked stream in the hydrocracked effluent line 48 and fed to the product fractionation column 80. The cold flashed bottoms line may boil up to the diesel boiling range, having a T95 between about 343° C. (650° F.) and about 399° C. (750° F.) using the TBP distillation method. The product fractionation column 80 may be in downstream communication with the hydrocracking reactor 40. In an aspect, the product fractionation column 80 comprises a single fractionation column. The product fractionation column 80 may be in downstream communication with the cold separator 50 and the cold flash drum 70.

The product fractionation column 80 may fractionate the cold flash liquid hydrocracked stream to provide a product overhead stream comprising LPG and light naphtha (LN) and a product bottoms stream comprising heavy naphtha (HN) and distillate. The distillate stream may comprise diesel and/or it may comprise kerosene. The cut point between LN and HN may be between 77° C. (170° F.) and 99° C. (210° F.). An overhead stream from the product fractionation column 80 may be cooled and separated in a receiver 82 to provide a net overhead gas stream comprising ethane and lighter gases including hydrogen sulfide in a net off-gas stream in an off-gas line 84 and a net liquid overhead stream comprising LPG and LN in a net overhead liquid line 86. A reflux portion of the receiver liquid may be returned to the product fractionation column 80. A bottoms stream in a product bottoms line 85 from the product fractionation column 80 may be split between a net product bottoms stream in a net product bottoms line 88 and a boilup stream which is reboiled in a fired heater and returned to the product fractionation column 80 in a reboil line 87. The product fractionation column 80 may be operated at a temperature between about 204° C. (400° F.) and about 260° C. (500° F.) and a pressure between about 690 and about 1379 kPa. The net product bottoms stream in the net product bottoms line 88 comprises more heavy naphtha than the net product overhead stream in the net product overhead liquid line 86.

The net product liquid overhead stream in the net product liquid overhead line 86 is fed to a debutanizer fractionation column 90 to separate LPG from light naphtha. The debutanizer fractionation column 90 may fractionate the net liquid overhead stream to provide a debutanizer overhead stream comprising LPG and a debutanized bottoms stream comprising light naphtha. An overhead stream from the debutanizer fractionation column 90 may be cooled and separated in a receiver 92 to provide an overhead gas stream comprising additional ethane and lighter gases including the remaining hydrogen sulfide in a debutanizer off-gas stream in a debutanizer off-gas line 94 and a net debutanizer liquid overhead stream comprising LPG in a net debutanizer overhead liquid line 96. A reflux portion of the receiver liquid may be returned to the debutanizer fractionation column 90. A debutanized bottoms stream from the debutanizer fractionation column may be split between a net debutanized bottoms stream in a net debutanized bottoms line 98 and a debutanized boilup stream in a debutanized reboil line 100. The debutanized boilup stream in the debutanized reboil line 100 may be heat exchanged with the net product bottoms stream in the net product bottoms line 88 in an indirect heat exchanger 102. The temperature of the net product bottoms stream is hot enough to reboil the debutanized boilup stream without the need for a fired heater that relies on external utilities. The debutanized boilup stream is returned to the debutanizer fractionation column 90 after heat exchange and reboiling. The debutanizer fractionation column may be operated at a temperature between about 121° C. (250° F.) and about 177° C. (350° F.) and a pressure between about 690 and about 1379 kPa. The debutanized bottoms stream in the debutanized bottoms line 98 comprises more light naphtha than the debutanizer net overhead stream in the debutanizer net overhead liquid line 96.

The net debutanized bottoms stream in the net debutanized bottoms line 98 comprising LN can have a T5 between about 7° C. (45° F.) and 16° C. (60° F.) and a T95 between about 71° C. (160° C.) and 82° C. (180° F.). The debutanizer net liquid overhead stream comprising LPG in the debutanizer net overhead liquid line 96 can comprise between about 10 and about 30 mol % propane and between about 60 and about 90 mol % butane.

The net product bottoms stream in the net product bottoms line 88 is heat exchanged with the debutanized boilup stream in the reboil line 100 in a heat exchanger 102 to cool the former and may be let down in pressure before it is fed to a main fractionation column 110 to separate HN from distillate. The main fractionation column 110 may fractionate the net product bottoms stream to provide a main overhead stream comprising HN and a main bottoms stream comprising distillate such as kerosene and/or diesel. The main overhead stream from the main fractionation column 110 may be cooled to complete condensation to provide a net main overhead stream comprising HN in a main overhead line 116. A reflux portion of the main overhead stream may be returned to the main fractionation column 110. A main bottoms stream from the main fractionation column 110 may be split between a net main bottoms stream in a net main bottoms line 118 and a main boilup stream in a main reboil line. The main boilup stream in the main reboil line is reboiled in a fired heater and returned to the main fractionation column 110. The main fractionation column 110 may be operated at a temperature between about 204° C. (400° F.) and about 260° C. (500° F.) and a pressure between about 103 and about 345 kPa (gauge) which is less than in the debutanizer fractionation column 90 and in the product fractionation column 80. The net main bottoms stream in the net main bottoms line 118 comprises more distillate than the net main overhead stream in the net main overhead liquid line 116.

The net main bottoms stream in the net main bottoms line 118 comprising kerosene and/or diesel can have a T5 between about 177° C. (350° F.) and about 204° C. (400° F.) and a T95 between about 266° C. (510° F.) and about 371° C. (700° F.) using the ASTM D-86 distillation method. The net main overhead stream comprising HN in the net main overhead line 116 can have a T5 between about 99° C. (210° F.) and about 110° C. (230° F.) and a T95 between about 154° C. (310° F.) and about 193° C. (380° F.) using the ASTM D-86 distillation method. The naphtha cut point between naphtha and distillate may be between about 150° C. (302° F.) and about 200° C. (392° F.).

Accordingly, the cracked diesel can be fractionated into LPG, LN, HN and distillate comprising kerosene and/or diesel without a stripper and with only two reboiler heaters that rely on external utilities such as fired heaters.

Figure 2:
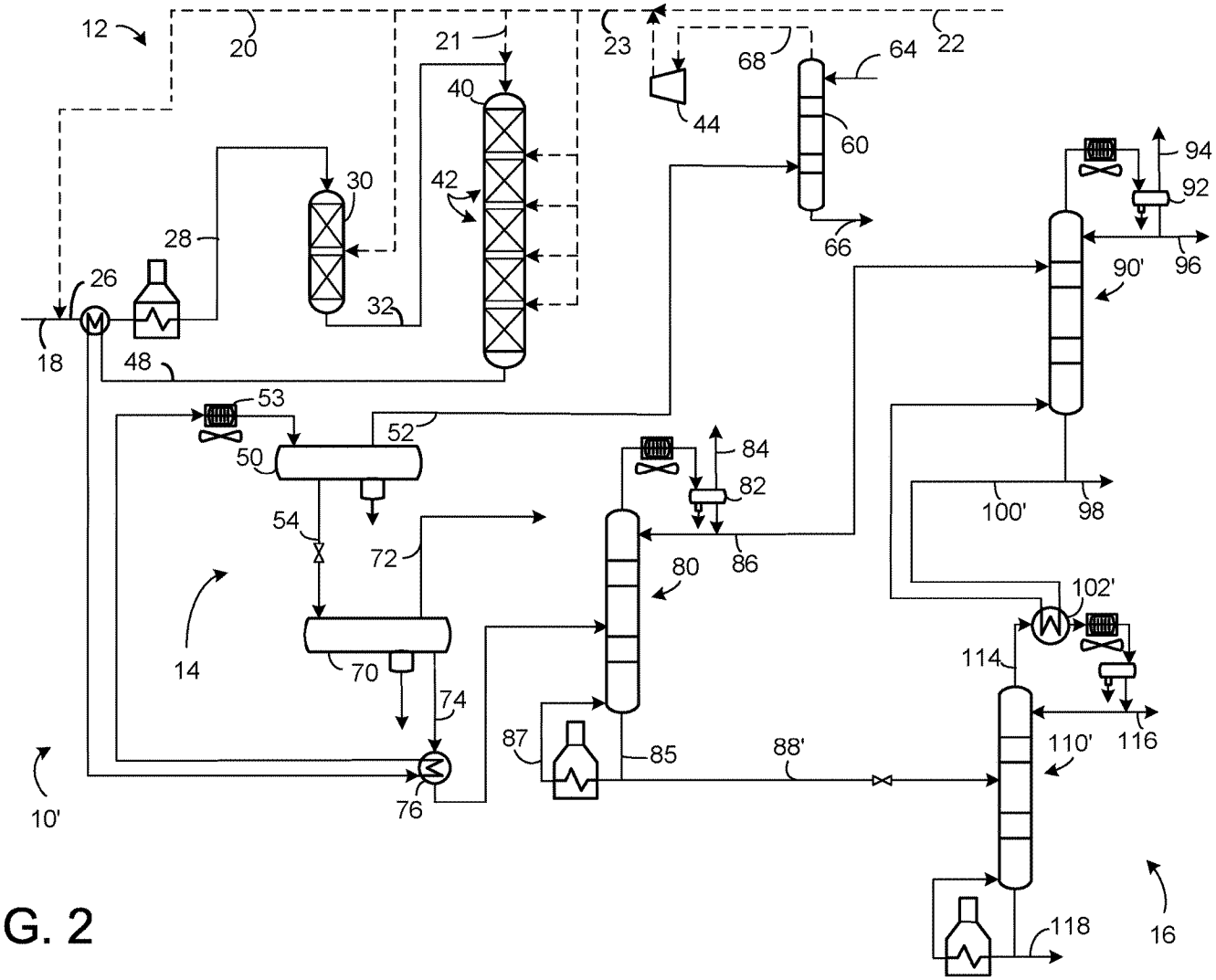
FIG. 2 is an alternative process flow diagram to FIG. 1.

FIG. 2 shows an alternate embodiment to FIG. 1 in which a boilup stream in the reboil line 100' from a debutanizer fractionation column 90' is heat exchanged with a main overhead stream in a main overhead line 114 from the main fractionation column 110'. Elements in FIG. 2 with the same configuration as in FIG. 1 have the same reference numeral as in FIG. 1. Elements in FIG. 2 which have a different configuration as the corresponding element in FIG. 1 have the same reference numeral but designated with a prime symbol (')). The configuration and operation of the embodiment of FIG. 2 is essentially the same as in FIG. 1 unless otherwise indicated.

A debutanized bottoms stream from the debutanizer fractionation column 90' may be split between a net debutanized bottoms stream in a debutanized bottoms line 98 and a debutanized boilup stream in a debutanized reboil line 100'. The debutanized boilup stream in the debutanized reboil line 100' is indirectly heat exchanged with the main overhead stream in the main overhead line 114 in a main overhead heat exchanger 102' before it is fully condensed. The net main overhead stream in a net main overhead line 116 is taken from the condensed main overhead stream from main overhead line 114. The temperature of the main overhead stream is hot enough to reboil the debutanized boilup stream without the need for a heater that relies on external utilities for heater duty. The debutanized boilup stream is returned to the debutanizer fractionation column 90' in debutanized reboil line 110' after heat exchange and reboiling. The debutanizer fractionation column 90' may be operated at a temperature between about 121° C. (250° F.) and about 177° C. (350° F.) and a pressure between about 690 and about 1379 kPa. The net debutanized bottoms stream in the net debutanized bottoms line 98 comprises more light naphtha than in the debutanizer net overhead stream in the debutanizer net overhead liquid line 96.

The net product bottoms stream in the net product bottoms line 88' is let down in pressure and fed to the main fractionation column 110'. All other aspects of FIG. 2 are essentially the same as described for FIG. 1.

Accordingly, the cracked diesel can be fractionated into LPG, LN, HN and distillate comprising kerosene and/or diesel without a stripper column and with only two reboiler heaters that rely on external utilities such as a fired heater.

Specific Embodiments

While the following is described in conjunction with specific embodiments, it will be understood that this description is intended to illustrate and not limit the scope of the preceding description and the appended claims.

A first embodiment of the invention is a process comprising hydrocracking a diesel feed stream in a hydrocracking reactor with a hydrogen stream over hydrocracking catalyst to provide a hydrocracked stream; separating the hydroprocessed effluent stream in a separator to provide a vaporous hydrocracked stream and a liquid hydrocracked stream; fractionating the liquid hydrocracked stream in a first fractionation column to provide a first overhead stream comprising LPG and light naphtha and a first bottoms stream comprising heavy naphtha and kerosene; fractionating the first overhead stream in a second fractionation column to provide a second overhead stream comprising LPG and a second bottoms stream comprising light naphtha; and fractionating the first bottoms stream in a third fractionation column to provide a third overhead stream comprising heavy naphtha and a second bottoms stream comprising distillate. An embodiment of the invention is one, any or all of prior embodiments in this paragraph up through the first embodiment in this paragraph further comprising heat exchanging the first bottoms stream with a boilup stream taken from the second bottoms stream to reboil the boilup stream and return it to the second fractionation column. An embodiment of the invention is one, any or all of prior embodiments in this paragraph up through the first embodiment in this paragraph wherein the third fractionation column is operated at a lower pressure than the second fractionation column. An embodiment of the invention is one, any or all of prior embodiments in this paragraph up through the first embodiment in this paragraph wherein the third fractionation column is operated at a lower pressure than the first fractionation column. An embodiment of the invention is one, any or all of prior embodiments in this paragraph up through the first embodiment in this paragraph further comprising taking the first overhead stream as a liquid stream. An embodiment of the invention is one, any or all of prior embodiments in this paragraph up through the first embodiment in this paragraph further comprising taking the second overhead stream as a liquid stream. An embodiment of the invention is one, any or all of prior embodiments in this paragraph up through the first embodiment in this paragraph wherein the first bottoms stream comprises more heavy naphtha than the first overhead stream. An embodiment of the invention is one, any or all of prior embodiments in this paragraph up through the first embodiment in this paragraph wherein the diesel feed stream has a T5 between about 150° C. (302° F.) and about 200° C. (392° F.) and a T95 between about 343° C. (650° F.) and about 399° C. (750° F.) using the TBP distillation method. An embodiment of the invention is one, any or all of prior embodiments in this paragraph up through the first embodiment in this paragraph wherein the third bottoms stream has a T5 between about 177° C. (350° F.) and about 204° C. (400° F.) and a T95 between about 266° C. (510° F.) and about 371° C. (700° F.) using the ASTM D-86 distillation method. An embodiment of the invention is one, any or all of prior embodiments in this paragraph up through the first embodiment in this paragraph further comprising heat exchanging the third overhead stream with a boilup stream taken from the second bottoms stream to reboil the boilup stream and return it to the second fractionation column. An embodiment of the invention is one, any or all of prior embodiments in this paragraph up through the first embodiment in this paragraph wherein the third overhead stream has a T5 between about 99° C. (210° F.) and about 110° C.

(230° F.) and a T95 between about 154° C. (310° F.) and about 193° C. (380° F.) using the ASTM D-86 distillation method.

A second embodiment of the invention is a process comprising hydrocracking a diesel feed stream in a hydrocracking reactor with a hydrogen stream over hydrocracking catalyst to provide a hydrocracked stream; separating the hydroprocessed effluent stream in a separator to provide a vaporous hydrocracked stream and a liquid hydrocracked stream; fractionating the liquid hydrocracked stream in a first fractionation column to provide a first overhead stream comprising LPG and light naphtha and a first bottoms stream comprising heavy naphtha and kerosene; fractionating the first overhead stream in a second fractionation column to provide a second overhead stream comprising LPG and a second bottoms stream comprising light naphtha; taking a boilup stream from the second bottoms stream and returning the boilup stream to the second fractionation column; fractionating the first bottoms stream in a third fractionation column to provide a third overhead stream comprising heavy naphtha and a second bottoms stream comprising distillate; and heat exchanging the first bottoms stream with the boilup stream to reboil the boilup stream. An embodiment of the invention is one, any or all of prior embodiments in this paragraph up through the second embodiment in this paragraph wherein the third fractionation column is operated at a lower pressure than the second fractionation column. An embodiment of the invention is one, any or all of prior embodiments in this paragraph up through the second embodiment in this paragraph wherein the third fractionation column is operated at a lower pressure than the first fractionation column. An embodiment of the invention is one, any or all of prior embodiments in this paragraph up through the second embodiment in this paragraph further comprising taking the first overhead stream as a liquid stream. An embodiment of the invention is one, any or all of prior embodiments in this paragraph up through the second embodiment in this paragraph wherein the first bottoms stream comprises a higher concentration of heavy naphtha than the first overhead stream.

A third embodiment of the invention is a process comprising hydrocracking a diesel feed stream, having a T5 between about 150° C. (302° F.) and about 200° C. (392° F.) and a T95 between about 343° C. (650° F.) and about 399° C. (750° F.) using the TBP distillation method, in a hydrocracking reactor with a hydrogen stream over hydrocracking catalyst to provide a hydrocracked stream; separating the hydroprocessed effluent stream in a separator to provide a vaporous hydrocracked stream and a liquid hydrocracked stream; fractionating the liquid hydrocracked stream in a first fractionation column to provide a first overhead stream comprising LPG and light naphtha and a first bottoms stream comprising heavy naphtha and kerosene; fractionating the first overhead stream in a second fractionation column to provide a second overhead stream comprising LPG and a second bottoms stream comprising light naphtha; and fractionating the first bottoms stream in a third fractionation column to provide a third overhead stream comprising heavy naphtha and a second bottoms stream comprising kerosene. An embodiment of the invention is one, any or all of prior embodiments in this paragraph up through the third embodiment in this paragraph wherein the third bottoms stream has a T5 between about 177° C. (350° F.) and about 204° C. (400° F.) and a T95 between about 266° C. (510° F.) and about 371° C. (700° F.) using the ASTM D-86 distillation method. An embodiment of the invention is one, any or all of prior embodiments in this paragraph up through the third embodiment in this paragraph wherein the third overhead stream has a T5 between about 99° C. (210° F.) and about 110° C. (230° F.) and a T95 between about 154° C. (310° F.) and about 171° C. (340° F.) using the ASTM D-86 distillation method. An embodiment of the invention is one, any or all of prior embodiments in this paragraph up through the third embodiment in this paragraph further comprising heat exchanging the first bottoms stream with a boilup stream taken from the second bottoms stream to reboil the boilup stream and return it to the second fractionation column.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A hydroprocessing process comprising:

hydrocracking a diesel feed stream in a hydrocracking reactor with a hydrogen stream over hydrocracking catalyst to provide a hydrocracked stream;

separating said hydroprocessed effluent stream in a separator to provide a vaporous hydrocracked stream and a liquid hydrocracked stream;

fractionating the liquid hydrocracked stream in a first fractionation column to provide a first overhead stream comprising LPG and light naphtha and a first bottoms stream comprising heavy naphtha and kerosene;

fractionating the first overhead stream in a second fractionation column to provide a second overhead stream comprising LPG and a second bottoms stream comprising light naphtha;

fractionating the first bottoms stream in a third fractionation column to provide a third overhead stream comprising heavy naphtha and the second bottoms stream comprising distillate; and heat exchanging the third overhead stream with a boilup stream taken from the second bottoms stream to reboil the boilup stream and return it to the second fractionation column.

2. The hydroprocessing process of claim 1 wherein the third fractionation column is operated at a lower pressure than the second fractionation column.

3. The hydroprocessing process of claim 1 wherein the third fractionation column is operated at a lower pressure than the first fractionation column.

4. The hydroprocessing process of claim 1 further comprising taking the first overhead stream as a liquid stream.

5. The hydroprocessing process of claim 1 further comprising taking the second overhead stream as a liquid stream.

6. The hydroprocessing process of claim 1 wherein the first bottoms stream comprises more heavy naphtha than the first overhead stream.

7. The hydroprocessing process of claim 1 wherein the diesel feed stream has a T5 between about 150° C. (302° F.) and about 200° C. (392° F.) and a T95 between about 343° C. (650° F.) and about 399° C. (750° F.) using the TBP distillation method.

8. The hydroprocessing process of claim 1 wherein said third bottoms stream has a T5 between about 177° C. (350° F.) and about 204° C. (400° F.) and a T95 between about 266° C. (510° F.) and about 371° C. (700° F.) using the ASTM D-86 distillation method.

9. The hydroprocessing process of claim 1 wherein said third overhead stream has a T5 between about 99° C. (210° F.) and about 110° C. (230° F.) and a T95 between about 154° C. (310° F.) and about 193° C. (380° F.) using the ASTM D-86 distillation method.

10. A hydroprocessing process comprising:

hydrocracking a diesel feed stream in a hydrocracking reactor with a hydrogen stream over hydrocracking catalyst to provide a hydrocracked stream;

separating said hydroprocessed effluent stream in a separator to provide a vaporous hydrocracked stream and a liquid hydrocracked stream;

fractionating the liquid hydrocracked stream in a first fractionation column to provide a first overhead stream comprising LPG and light naphtha and a first bottoms stream comprising heavy naphtha and kerosene;

fractionating the first overhead stream in a second fractionation column to provide a second overhead stream comprising LPG and a second bottoms stream comprising light naphtha;

taking a boilup stream from the second bottoms stream and returning the boilup stream to the second fractionation column;

fractionating the first bottoms stream in a third fractionation column to provide a third overhead stream comprising heavy naphtha and the second bottoms stream comprising distillate; and heat exchanging the first bottoms stream with the boilup stream to reboil the boilup stream.

11. The hydroprocessing process of claim 10 wherein the third fractionation column is operated at a lower pressure than the second fractionation column.

12. The hydroprocessing process of claim 10 wherein the third fractionation column is operated at a lower pressure than the first fractionation column.

13. The hydroprocessing process of claim 10 further comprising taking the first overhead stream as a liquid stream.

14. The hydroprocessing process of claim 10 wherein the first bottoms stream comprises a higher concentration of heavy naphtha than the first overhead stream.

15. A hydroprocessing process comprising:

hydrocracking a diesel feed stream, having a T5 between about 150° C. (302° F.) and about 200° C. (392° F.) and a T95 between about 343° C. (650° F.) and about 399° C. (750° F.) using the TBP distillation method, in a hydrocracking reactor with a hydrogen stream over hydrocracking catalyst to provide a hydrocracked stream;

separating said hydroprocessed effluent stream in a separator to provide a vaporous hydrocracked stream and a liquid hydrocracked stream;

fractionating the liquid hydrocracked stream in a first fractionation column to provide a first overhead stream comprising LPG and light naphtha and a first bottoms stream comprising heavy naphtha and kerosene;

fractionating the first overhead stream in a second fractionation column to provide a second overhead stream comprising LPG and a second bottoms stream comprising light naphtha; and fractionating the first bottoms stream in a third fractionation column to provide a third overhead stream comprising heavy naphtha and the second bottoms stream comprising kerosene; and heat exchanging the first bottoms stream with a boilup stream taken from the second bottoms stream to reboil the boilup stream and return it to the second fractionation column.

16. The hydroprocessing process of claim 15 wherein said third bottoms stream has a T5 between about 177° C. (350° F.) and about 204° C. (400° F.) and a T95 between about 266° C. (510° F.) and about 371° C. (700° F.) using the ASTM D-86 distillation method.

17. The hydroprocessing process of claim 15 wherein said third overhead stream has a T5 between about 99° C. (210° F.) and about 110° C. (230° F.) and a T95 between about 154° C. (310° F.) and about 171° C. (340° F.) using the ASTM D-86 distillation method.

* * * * *